US011035238B2

(12) United States Patent
Stilin et al.

(10) Patent No.: US 11,035,238 B2
(45) Date of Patent: Jun. 15, 2021

(54) AIRFOIL INCLUDING ADHESIVELY BONDED SHROUD

(71) Applicant: United Technologies Corporation, Farmington, CT (US)

(72) Inventors: Nicholas D. Stilin, Higganum, CT (US); Jeremy L. Fox, New Britain, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/787,710

(22) Filed: Feb. 11, 2020

(65) Prior Publication Data

US 2020/0232334 A1 Jul. 23, 2020

Related U.S. Application Data

(63) Continuation-in-part of application No. 13/527,036, filed on Jun. 19, 2012, now abandoned.

(51) Int. Cl.

| | |
|---|---|
| ***F01D 5/30*** | (2006.01) |
| ***F01D 5/22*** | (2006.01) |
| ***F01D 5/14*** | (2006.01) |

(52) U.S. Cl.

CPC ..... *F01D 5/303* (2013.01); *F01D 5/141* (2013.01); *F01D 5/147* (2013.01); *F01D 5/225* (2013.01); *F05D 2230/52* (2013.01); *F05D 2230/60* (2013.01)

(58) Field of Classification Search

CPC ..... F01D 5/303; F01D 5/141; F01D 5/147; F01D 5/225; F01D 5/02; F01D 5/30; F01D 9/04; F01D 9/041; F05D 2230/52; F05D 2230/60; F05D 2240/12; F05D 2240/80

See application file for complete search history.

(56) References Cited

U.S. PATENT DOCUMENTS

| | | | | |
|---|---|---|---|---|
| 4,378,961 A * | 4/1983 | Trousdell | ..... | F01D 9/042 415/137 |
| 4,594,761 A | 6/1986 | Murphy et al. | | |
| 4,655,682 A | 4/1987 | Kunz et al. | | |
| 4,832,568 A | 5/1989 | Roth et al. | | |

(Continued)

FOREIGN PATENT DOCUMENTS

| | | |
|---|---|---|
| EP | 2221454 | 8/2010 |

OTHER PUBLICATIONS

Extended European Search Report for European Application No. 13807627.8 dated Sep. 14, 2015.

(Continued)

*Primary Examiner* — Courtney D Heinle
*Assistant Examiner* — Danielle M. Christensen
(74) *Attorney, Agent, or Firm* — Carlson, Gaskey & Olds, P.C.

(57) ABSTRACT

An airfoil includes an airfoil body that extends between a leading edge and a trailing edge, a suction side and a pressure side, and a first end and a second end, a fitting located at one of the first end or the second end, the fitting including a body portion, a fillet portion, and a neck portion joining the body portion and the neck portion, the neck portion including a shelf, a fastener through the airfoil body, and a shroud having a complementary shape to the shelf such that the shroud nests in the shelf.

9 Claims, 6 Drawing Sheets

(56) References Cited

U.S. PATENT DOCUMENTS

| | | | | |
|---|---|---|---|---|
| 5,083,900 | A | 1/1992 | Carletti et al. | |
| 5,226,789 | A | 7/1993 | Donges | |
| 5,272,869 | A * | 12/1993 | Dawson | F01D 9/042 415/142 |
| 5,399,069 | A * | 3/1995 | Marey | F01D 9/042 415/189 |
| 5,411,370 | A | 5/1995 | Varsik | |
| 5,482,433 | A | 1/1996 | Norris et al. | |
| 5,562,419 | A | 10/1996 | Crall | |
| 6,343,912 | B1 | 2/2002 | Manteiga et al. | |
| 6,619,917 | B2 | 9/2003 | Glover et al. | |
| 6,632,070 | B1 | 10/2003 | Tiemann | |
| 7,153,099 | B2 | 12/2006 | Queriault et al. | |
| 7,311,495 | B2 | 12/2007 | Ashley et al. | |
| 7,481,618 | B2 | 1/2009 | Booth et al. | |
| 7,524,163 | B2 | 4/2009 | Self | |
| 8,672,623 | B2 * | 3/2014 | Harper | F01D 9/042 415/209.2 |
| 8,834,125 | B2 * | 9/2014 | Alvanos | F01D 5/282 416/220 R |
| 2002/0076320 | A1 | 6/2002 | Glover et al. | |
| 2002/0253885 | | 6/2002 | Glover et al. | |
| 2007/0172349 | A1 | 7/2007 | Abgrall et al. | |
| 2008/0232956 | A1 * | 9/2008 | Baldauf | F01D 5/22 415/174.2 |
| 2008/0253885 | A1 | 10/2008 | Foose et al. | |
| 2009/0148283 | A1 | 6/2009 | Mons et al. | |
| 2010/0080692 | A1 | 5/2010 | Tudor et al. | |
| 2013/0287562 | A1 * | 10/2013 | Ishigure | F01D 25/246 415/208.1 |
| 2015/0204245 | A1 * | 7/2015 | Marasco | F01D 11/006 415/110 |
| 2016/0194971 | A1 * | 7/2016 | Yagi | F01D 9/041 415/208.1 |
| 2020/0025001 | A1 * | 1/2020 | Boisson | F04D 29/646 |

OTHER PUBLICATIONS

International Preliminary Report on Patentability for PCT Application No. PCT/US2013/043815 dated Dec. 31, 2014.

International Search Report for International Application No. PCT/US2013/043815 dated Sep. 11, 2013.

* cited by examiner

AIRFOIL INCLUDING ADHESIVELY BONDED SHROUD

CROSS-REFERENCE TO RELATED APPLICATION

This disclosure is a continuation-in-part of U.S. patent application Ser. No. 13/527,036 filed Jun. 19, 2012.

BACKGROUND

This disclosure relates to improvements in shrouded airfoils.

Airfoils, such as airfoils in gas turbine engines, may include a shroud at an inner diameter, outer diameter or both. The airfoils are circumferentially arranged such that inner diameter shrouds bound an inner diameter of a gas path and outer diameter shrouds bound an outer diameter of the gas path.

The airfoils are secured to static structures, such as cases, using fittings at the inner and outer diameters. The fittings and shrouds are integrally formed in a forging process from a suitable metallic alloy or are integrally formed by machining from a single monolithic piece of a suitable metallic alloy.

SUMMARY

An airfoil according to an example of the present disclosure includes an airfoil body that extends between a leading edge and a trailing edge, a suction side and a pressure side, and a first end and a second end. A fitting is located at one of the first end or the second end. The fitting includes a body portion, a fillet portion, and a neck portion joining the body portion and the neck portion. The neck portion includes a shelf, and here is a fastener through the airfoil body. A shroud has a complementary shape to the shelf such that the shroud nests in the shelf.

In a further embodiment of any of the foregoing embodiments, the shroud comprises a polymeric material.

In a further embodiment of any of the foregoing embodiments, the fitting is metallic and the shroud is polymeric.

The airfoil as recited in claim 1, further comprising a seal member at a perimeter edge of the shroud.

In a further embodiment of any of the foregoing embodiments, the perimeter edge includes a groove that is complementary in shape to the seal member.

In a further embodiment of any of the foregoing embodiments, the groove has a cross-sectional profile of a partial circle.

A gas turbine engine according to an example of the present disclosure includes an airfoil as in of any of the foregoing embodiments.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
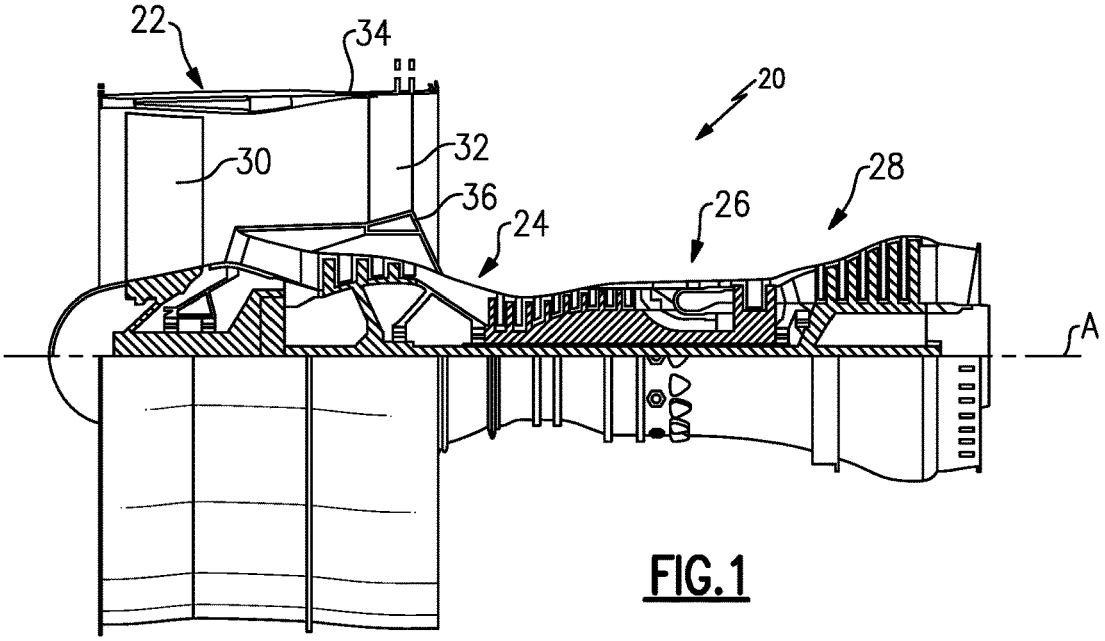
FIG. 1 shows an example gas turbine engine.

FIG. 1 schematically illustrates a gas turbine engine 20. The gas turbine engine 20 disclosed herein is a two-spool turbofan that generally includes a fan section 22, a compressor section 24, a combustor section 26 and a turbine section 28 that are arranged along a central axis A. Although the illustrated example is a turbofan gas turbine engine and the examples herein are described with reference to an airfoil in the engine 20, it is to be understood that this disclosure is not limited to gas turbine engines or turbine engine airfoils. The teachings herein can be applied to other types of shrouded airfoils and turbine engines, including single- or three-spool architectures.

The fan section 22 of the gas turbine engine 20 includes a plurality of rotatable blades 30 and a plurality of static, structural exit guide vanes 32. As known, the vanes 32 are circumferentially arranged around the central axis A between an outer structure 34 and an inner structure 36, such as cases.

Figure 2:
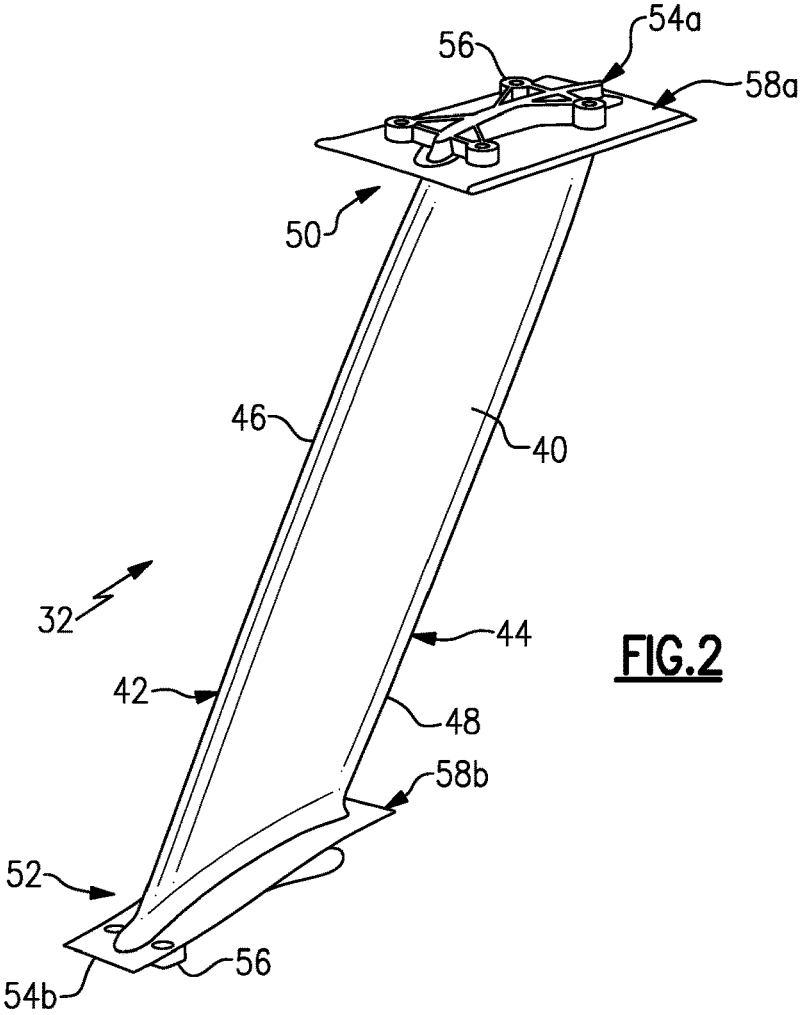
FIG. 2 shows a perspective view of an airfoil of the gas turbine engine of FIG. 1.

FIG. 2 shows an example of one of the vanes 32, which is considered to be an airfoil. The vane 32 includes an airfoil body 40 that extends between a leading edge 42 and the trailing edge 44, a suction side 46 and a pressure side 48, and a first end 50 and a second end 52. Relative to the central axis A, the first end 50 is an outer diameter end of the vane 32 and the second end 52 is an inner diameter end of the vane 32.

The vane 32 further includes a first fitting 54*a* located at the first end 50 and a second fitting 54*b* located at the second end 52. Each of the fittings 54*a*/54*b* is or includes a metallic material and includes one or more mounting lugs 56 for securing the vane 32 to the respective structures 34/36 in a known manner, such as by using fasteners.

The vane 32 further includes a first shroud 58*a* that is adhesively bonded to the first fitting 54*a* and a second shroud 58*b* that is adhesively bonded to the second fitting 54*b*. Thus, in this example, the vane 32 is shrouded at both the first end 50 and the second end 52. It is to be understood, however, that other types of airfoils may be shrouded at only one end, and that the examples herein are also applicable to such airfoils. As can be appreciated, use of the shrouds 58*a*/58*b* that are separate and distinct pieces from the airfoil body 40 and the respective fittings 54*a*/54*b* permits the shrouds 58*a*/58*b* to be made of different material than either the airfoil body 40 or the fittings 54*a*/54*b*.

Figure 3:
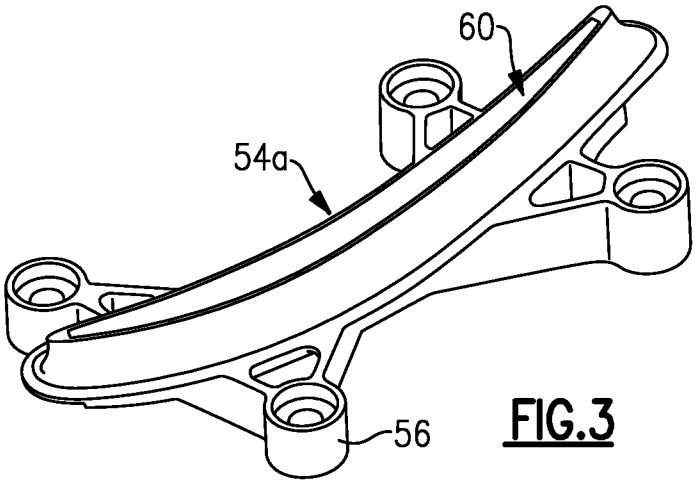
FIG. 3 shows an isolated view of a first, outer diameter fitting of the airfoil of FIG. 2.
Figure 4:
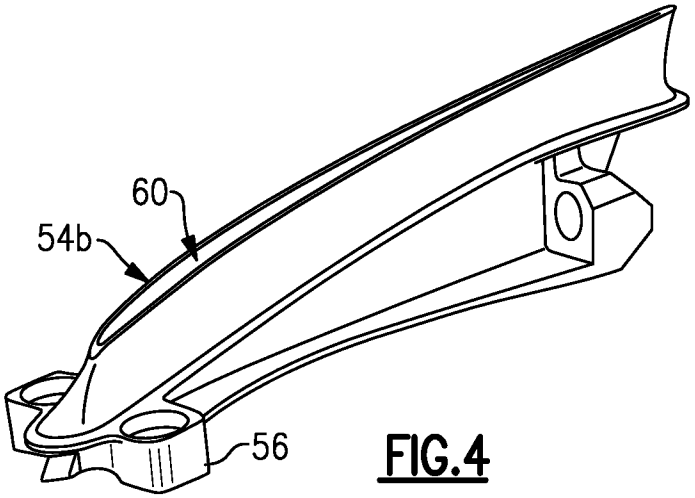
FIG. 4 shows an isolated view of a second, inner diameter fitting of the airfoil of FIG. 2.

FIGS. 3 and 4 show isolated views, respectively, of the first fitting 54*a* and the second fitting 54*b*. In this example, each of the fittings 54*a*/54*b* is a separate and distinct piece from the airfoil body 40. In this regard, each of the fittings 54*a*/54*b* includes a corresponding pocket 60 into which the airfoil body 40 is received. The airfoil body 40 can be adhesively bonded to the respective fittings 54*a*/54*b*. In other examples, the fittings 54*a*/54*b* can be integral with the airfoil body 40.

Figure 5:
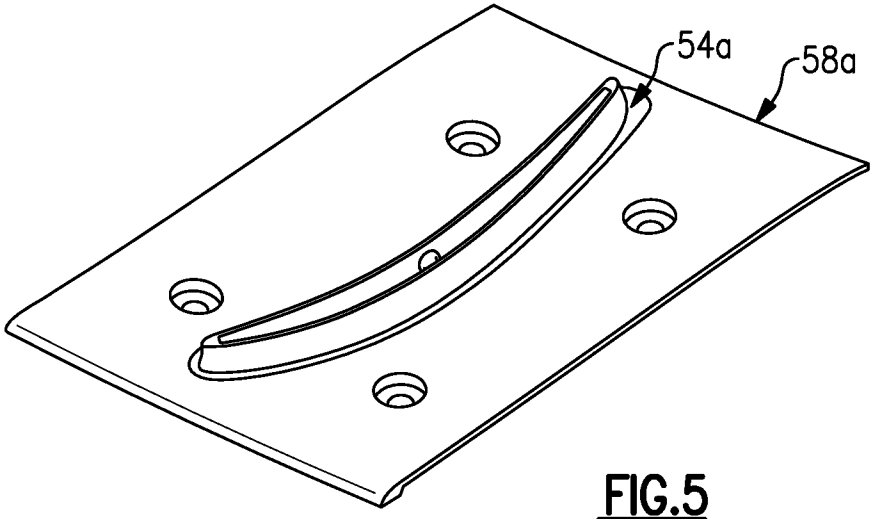
FIG. 5 shows an isolated view of the first, outer diameter fitting and shroud of the airfoil of FIG. 2.
Figure 6:
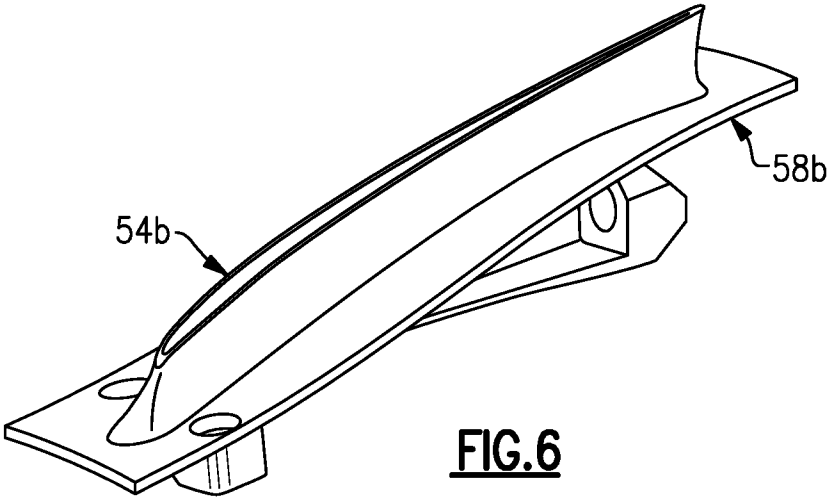
FIG. 6 shows an isolated view of the second, inner diameter fitting and shroud of the airfoil of FIG. 2.
Figure 7:
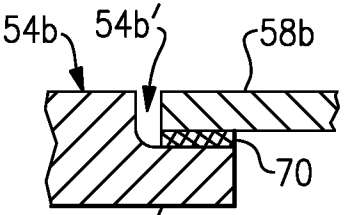
FIG. 7 shows a cross-section of a shroud adhesively bonded to a fitting.

FIGS. 5 and 6 show isolated views, respectively, of the shrouds 58*a*/58*b* adhesively bonded to the fittings 54*a*/54*b*. FIG. 7 shows a cross-section through an interface between the second fitting 54*b* and the second shroud 58*b* adhesively bonded to the second fitting 54*b*. It is to be understood that the interface between the first fitting 54*a* and the first shroud 58*a* is similar to the interface shown in FIG. 7. As shown, the second shroud 58*a* is adhesively bonded to the second fitting 54*b* by an adhesive 70. In one example, the adhesive 70 is an epoxy adhesive. In other examples, other types of adhesives can be used that are suitable for the expected operating temperature of the airfoil.

The second fitting 54*b* includes a flange F to which the second shroud 58*a* is adhesively bonded. In this example, the flange F includes a rabbet 54*b*'. The rabbet 54*b*', or ledge, supports the adhesive 70 for bonding the second shroud 58*b* thereto. Thus, the second shroud 58*b* is adhesively bonded to the rabbet 54*b*'. A method of assembling the vane 32 therefore includes providing the vane 32 as described, and adhesively bonding the shrouds 58*a*/58*b* to the fittings 54*a*/54*b*.

Figure 8:
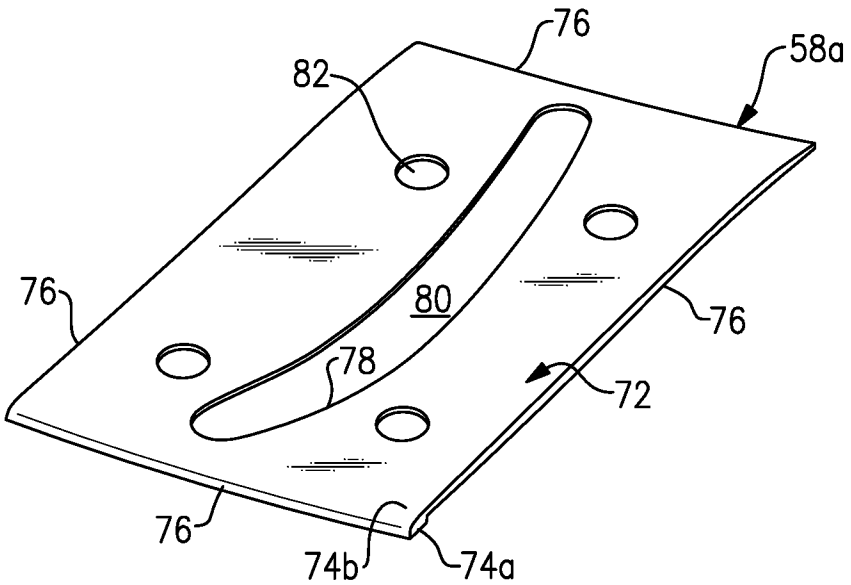
FIG. 8 shows an isolated view of a shroud of the airfoil of FIG. 2.

FIG. 8 shows an isolated view of the first shroud 58*a*. In this example, the first shroud 58*a* includes a shroud body 72 that extends between first and second broadsides 74*a*/74*b*, perimeter edges 76, which are axially and circumferentially facing surfaces, and interior edges 78 that define an elongated, arcuate opening 80 extending between the first and second broadsides 74*a*/74*b*. The opening 80 is generally elongated in a direction parallel to the central axis A of the gas turbine engine 20. The opening 80 also has the arcuate shape, which corresponds to the arcuate shape of the cross-section of the airfoil body 40.

The first shroud 58 also optionally includes a plurality of additional openings 82 that correspond to the mounting lugs 56 on the first fitting 54*a*. Depending on the geometry of the first shroud 58*a* and location of the mounting lugs 56, other examples may exclude the additional openings 82.

It is to be understood that the second shroud 58*b* has similar features as the first shroud 58*a* with regard to including a shroud body, first and second broadsides, perimeter edges and interior edges that define an elongated, arcuate opening. As can be appreciated, the contouring and size of the second shroud 58*b* may differ and the elongated, arcuate opening of the second shroud 58*b* may have a different geometry that corresponds to the cross-section of the airfoil body 40 at the inner diameter. Also, the additional optional openings may be positioned differently to align with the mounting lugs 56 on the second fitting 54*b*.

In this example, the first shroud 58*a* is a monolithic piece. That is, the first shroud 58*a* is a single piece of material that is free of joints or seams. Thus, in the assembly of the vane 32, the airfoil body 40 extends through the elongated, arcuate opening 80 and into the corresponding first fitting 54*a* (or second fitting 54*b* for the elongated arcuate opening of the second shroud 58*b*).

Figure 9:
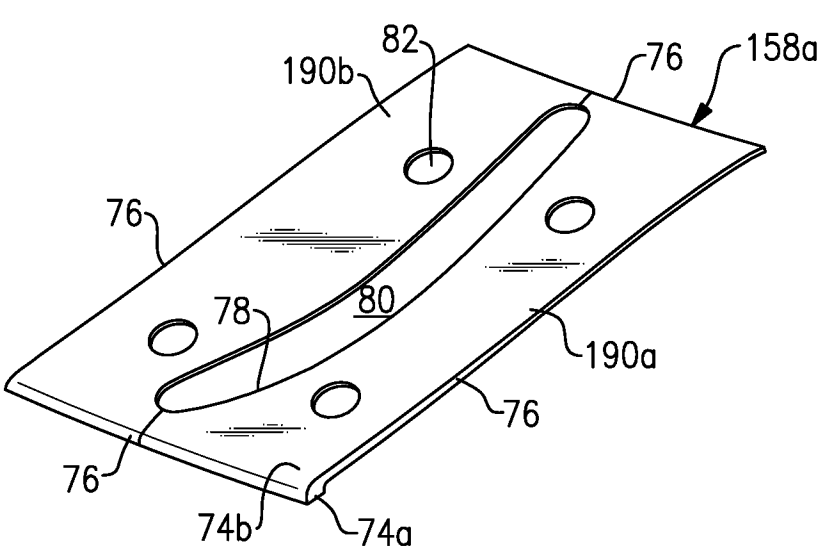
FIG. 9 shows another example shroud having a separate and distinct shroud pieces.

FIG. 9 shows a modified example of a first shroud 158*a*. In this disclosure, like reference numerals designate like elements where appropriate and reference numerals with the addition of one-hundred or multiples thereof designate modified elements that are understood to incorporate the same features and benefits of the corresponding elements. In this example, the first shroud 158*a* includes a plurality of separate and distinct pieces 190*a*/190*b*. Each of the pieces 190*a*/190*b* includes a portion of the interior edges 78 such that, when assembled together, the pieces 190*a*/190*b* define the complete perimeter of the elongated, arcuate opening 80, which circumscribes the first fitting 54*a* similar to as shown in FIG. 6.

For example, the pieces 190*a*/190*b* are initially separate and are then assembled around the first fitting 54*a* and adhesively bonded thereto to form the complete first shroud 158*a*. Thus, the shroud 158*a* can be fitted onto an existing vane as a retrofit, for example. The use of the separate pieces 190*a*/190*b* also facilitates removal of the shroud 158*a* for replacement with a new, similar shroud, should the shroud 158*a* require replacement.

Figure 10:
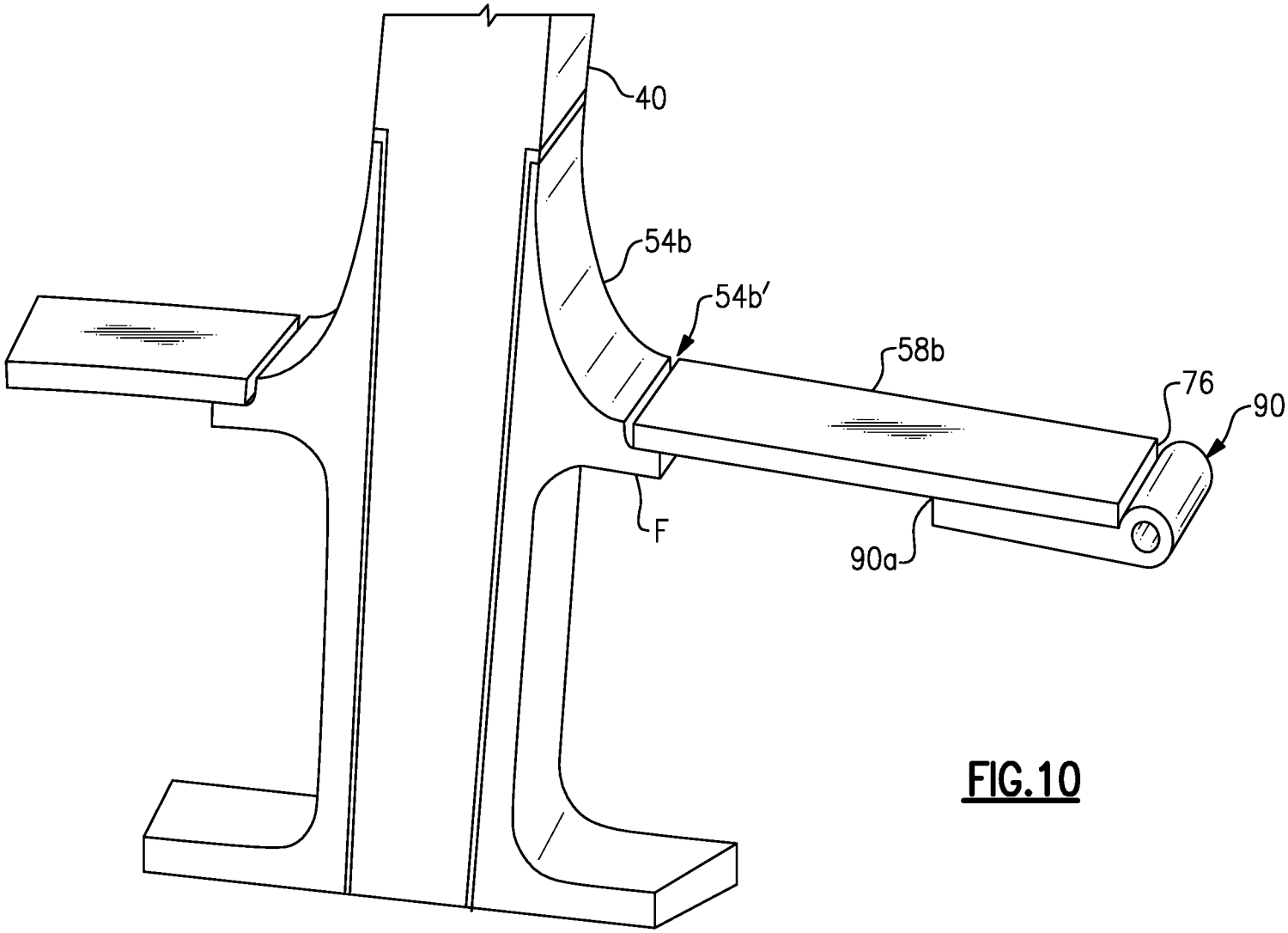
FIG. 10 shows a sectioned, perspective view of a fitting and a shroud that includes a seal member.
Figure 11:
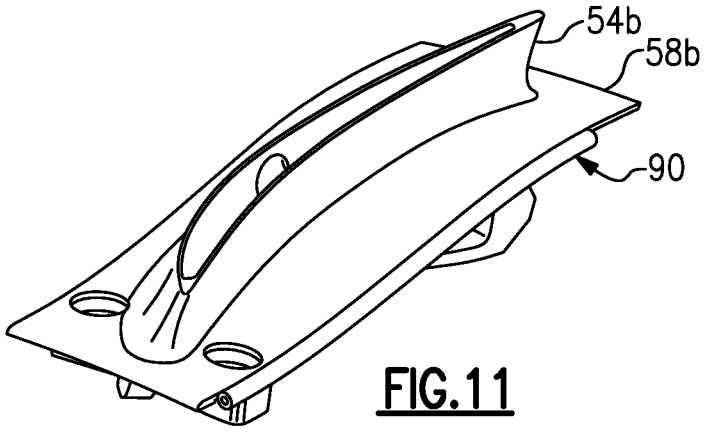
FIG. 11 shows a perspective view of a second, inner diameter fitting, shroud and seal member.
Figure 12:
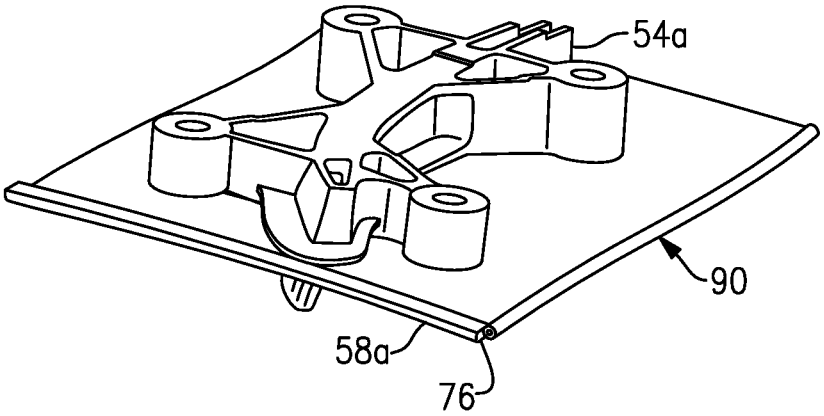
FIG. 12 shows a perspective view of a first fitting, shroud and seal member.

FIG. 10 shows a perspective, sectioned view through a portion of the second fitting 54*b*. In this example, the second shroud 58*b* further includes a seal member 90 attached at one of the perimeter edges 76 of the second shroud 58*b*. The second fitting 54*b*, the second shroud 58*b* and the seal member 90 are shown in full view in FIG. 11. Similarly, as shown in FIG. 12, the first shroud 58*a* can likewise include a seal member 90. When the vanes 32 are circumferentially arranged in the gas turbine engine 20, the seal members 90 bear against a neighboring shroud 58*a*/58*b* to provide a gas path seal.

In the illustrated example, the seal member 90 is adhesively bonded to the second shroud 58*b* using an adhesive 90*a*. Similar to the adhesive 70, the adhesive 90*a* can be an epoxy adhesive. Alternatively, the adhesive 90*a* can be another type of adhesive that is suitable for the operating temperature of the airfoil. In another alternative, the seal member 90 can be integrally formed with the second shroud 58*b*, such as in a co-molding or over-molding operation.

Figure 13:
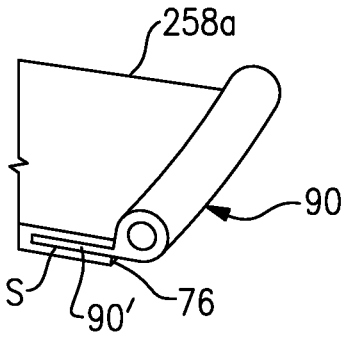
FIG. 13 shows a portion of a shroud having a slot receiving a seal member.

FIG. 13 shows a portion of a modified first shroud 258*a*. In this example, the first shroud 258*a* includes a slot S extending into one of the perimeter edges 76. The seal member 90 includes a flange 90' that is received into the slot S to secure the seal member 90 and the first shroud 258*a* together. The slot S can be sized in correspondence with the size of the flange 90' such that there is an interference fit or snap fit between the first shroud 258*a* and the seal member 90. Alternatively, an adhesive can be used to secure the seal member 90 within the slot S. Similarly, the second shroud 58*b* can also include a slot for attaching the seal member 90.

Using the shrouds disclosed herein that are separate and distinct pieces from the airfoil body 40 and the respective fittings 54*a*/54*b* permits the shrouds to be made of different materials than either the airfoil body 40 or the fittings 54*a*/54*b*. In one example, the shrouds are, or include, a polymeric material. In a further example, the polymeric material is a reinforced polymeric material that includes glass fibers, carbon fibers, or other reinforcement additives. In comparison to airfoils that are made entirely of metal alloys, the airfoils disclosed herein provide a weight reduction because of the use of the polymeric material. Furthermore, metallic shrouds that are integrally formed with fittings require significant raw material and machining to attain the final geometric configuration. However, by forming the shrouds disclosed herein from the polymeric material, the shrouds can be formed to the required geometry and tolerances using known polymer forming processes, such as injection molding.

Figure 14:
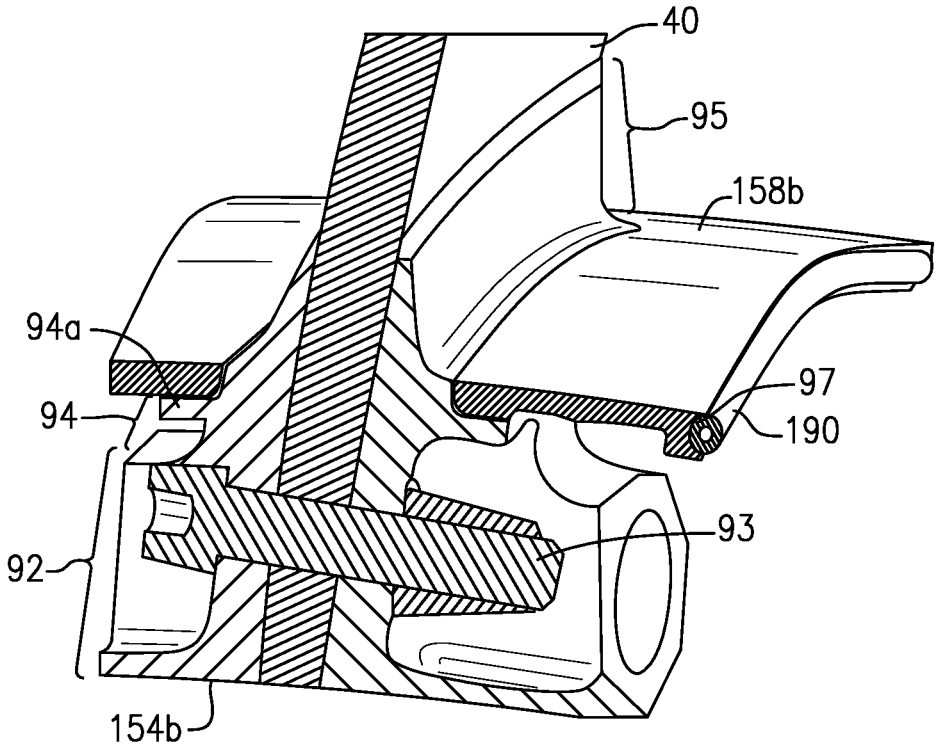
FIG. 14 illustrates another example fitting and shroud.

FIG. 14 illustrates another example fitting 154*b* and shroud 158*b*. In this example, the fitting 154*b* includes a body portion 92 that receives a fastener 93 for securing the airfoil body 40 and the fitting 154*b* together. The fitting 154*b* further includes a neck portion 94 connected to the body portion 92, and a fillet portion 95 connected to the neck portion 94. The neck portion 94 includes a shelf 94*a* that extends at the perimeter of the fitting 156*b*. In one example, the shelf 94*a* is a continuous ring. The upper surface and corner of the shelf 94*a* is complementary to the bottom inside surface and edge of the shroud 158*b* such that the shroud 158*b* nests into the shelf 94*a*. In one example, the shroud 158*b* is also a continuous ring. An adhesive or mechanical fastener may be used to secure the shelf 94*a* and shroud 158*b* together. The fillet portion 95 of the fitting 154*b* may form a smooth, flush surface with the shroud 158*b*.

At its perimeter on one side, the shroud 158*b* includes a groove 97. The groove 97 has a curved cross-sectional profile, such as a partial- or semi-circle. A seal member 190 has a complementary profile to the groove 97 and is received into the groove 97. An adhesive may be used to secure the seal member 190 in the groove 97. The complementary shapes of the groove 97 and the seal member 190 facilitate proper seating of the seal element 190 in the groove 97.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An airfoil comprising:

an airfoil body extending between a leading edge and a trailing edge, a suction side and a pressure side, and a first end and a second end;

a fitting located at one of the first end or the second end, the fitting including a body portion, a fillet portion, and a neck portion joining the body portion and the fillet portion, the neck portion including a shelf and there being a slot that extends through the fillet portion, the neck portion, and the body portion, the airfoil body extending in the slot;

a fastener through the body portion and the airfoil body; and a shroud having a complementary shape to the shelf such that the shroud nests in the shelf.

2. The airfoil as recited in claim 1, wherein the shroud comprises a polymeric material.

3. The airfoil as recited in claim 1, wherein the fitting is metallic and the shroud is polymeric.

4. The airfoil as recited in claim 1, further comprising a seal member at a perimeter edge of the shroud.

5. The airfoil as recited in claim 4, wherein the perimeter edge includes a groove that is complementary in shape to the seal member.

6. The airfoil as recited in claim 5, wherein the groove has a cross-sectional profile of a partial circle.

7. A turbine engine comprising a fan section including the airfoil as recited in claim 1, a compressor section in communication with the fan section, a combustor in fluid communication with the compressor section, and a turbine section in fluid communication with the combustor.

8. The airfoil as recited in claim 1, wherein the fillet portion extends from the neck portion and opposite from the fillet portion the body portion extend from the neck portion.

9. The airfoil as recited in claim 8, wherein the airfoil body includes a though-hole from the suction side to the pressure side, and the fastener is disposed through the through-hole.

* * * * *